US010654064B2

(12) United States Patent
Custis

(10) Patent No.: US 10,654,064 B2
(45) Date of Patent: May 19, 2020

(54) WARNING SYSTEM FOR PROTECTING A FIRE SPRINKLER HEAD

(71) Applicant: John Dana Custis, Des Moines, IA (US)

(72) Inventor: John Dana Custis, Des Moines, IA (US)

(73) Assignee: John Dana Custis, West Des Moines, IA (US)

( * ) Notice: Subject to any disclaimer, the term of this patent is extended or adjusted under 35 U.S.C. 154(b) by 36 days.

(21) Appl. No.: 16/022,164

(22) Filed: Jun. 28, 2018

(65) Prior Publication Data

US 2020/0001316 A1 Jan. 2, 2020

(51) Int. Cl.

| | |
|---|---|
| ***B05B 15/16*** | (2018.01) |
| *G08B 17/00* | (2006.01) |
| *A62C 99/00* | (2010.01) |

(52) U.S. Cl.

CPC ..... *B05B 15/16* (2018.02); *A62C 99/009* (2013.01); *G08B 17/00* (2013.01)

(58) Field of Classification Search

CPC ..... B05B 15/16; A62C 99/009; A62C 37/08; A62C 31/28; A62C 8/08; G08B 17/00

USPC ..... 239/72, 73; 169/56, 37

See application file for complete search history.

(56) References Cited

U.S. PATENT DOCUMENTS

| | | | | |
|---|---|---|---|---|
| 2,893,648 A * | 7/1959 | Berry | B05B 1/28 239/499 |
| 3,727,695 A * | 4/1973 | Danton | A62C 37/08 169/37 |
| 2008/0271902 A1* | 11/2008 | Johnson | A62C 3/008 169/56 |

* cited by examiner

*Primary Examiner* — Christopher S Kim
(74) *Attorney, Agent, or Firm* — Zarley Law Firm, P.L.C.

(57) ABSTRACT

A warming system for protecting a fire sprinkler head during construction and demolition projects. The system includes an adapter attached to the sprinkler head, a protective cover that fits over the adapter, and a control system that is embedded in or attached to the protective cover. The control system includes at least one power supply, circuitry, a plurality of sensors, and an alarm.

15 Claims, 5 Drawing Sheets

WARNING SYSTEM FOR PROTECTING A FIRE SPRINKLER HEAD

BACKGROUND OF THE INVENTION

This invention is directed towards a warning system and more particularly a warning system for protecting a fire sprinkler head from damage.

Fire Sprinkler heads are well known in the art for use in reducing damage to a structure in the presence of fire. During construction projects, and particularly during remodeling and destruction projects, fire sprinkler heads are occasionally damaged by accident. In the worst case scenarios, this can lead to flooding and/or substantial water damage. To overcome this problem, there exists a need for a device that quickly and temporarily attaches to the supply line of a fire sprinkler head while maintaining the functionality of the sprinkler in case of fire. The device, which would create a zone of exclusion, would trigger an alarm if a man, man lift, ladder, building material, tool or similar object enters the zone of exclusion.

An objective of the present invention is to provide a warning system for a fire sprinkler head that reduces or eliminates damage to the sprinkler head during construction and demolition projects.

Another objective of the present invention is to provide a warning system for a fire sprinkler head that quickly and temporarily attaches to the fire sprinkler head.

A still further objective of the present invention is to provide a warning system for a fire sprinkler head that creates a zone of exclusion while maintaining the functionality of the fire sprinkler head.

These and other objectives will be apparent to one having ordinary skill in the art based upon the following written description, drawings, and claims.

SUMMARY OF THE INVENTION

A warning system for a fire sprinkler head includes an adapter, a protective cover, and a control system. The adapter preferably has two semi-circular pieces that when assembled form a disk upon which the protective cover rest.

The protective cover fits over the adapter and has a central opening and a slit that extends radially form the central opening to an outer edge. The control system is embedded within the protective cover and includes at least one power supply, circuitry, a plurality of sensors, and an alarm.

DETAILED DESCRIPTION

Figure 1:
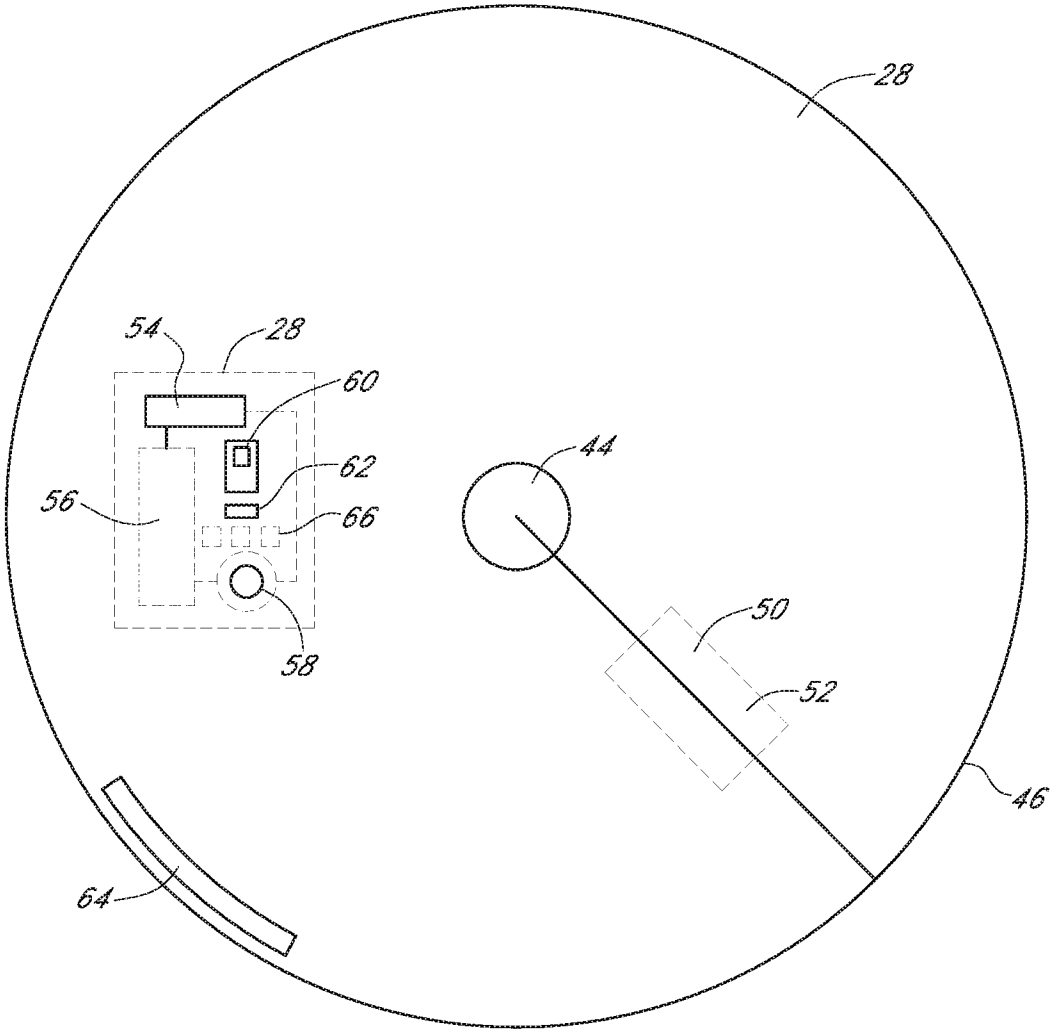
FIG. 1 is a top sectional view of an adapter for a warning system.
Figure 2:
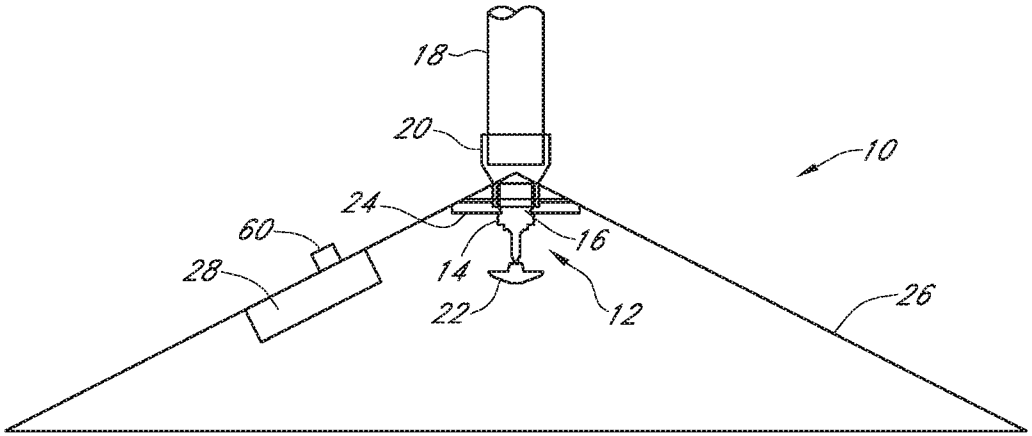
FIG. 2 is a top plan view of an adapter for a warning system.
Figure 3:
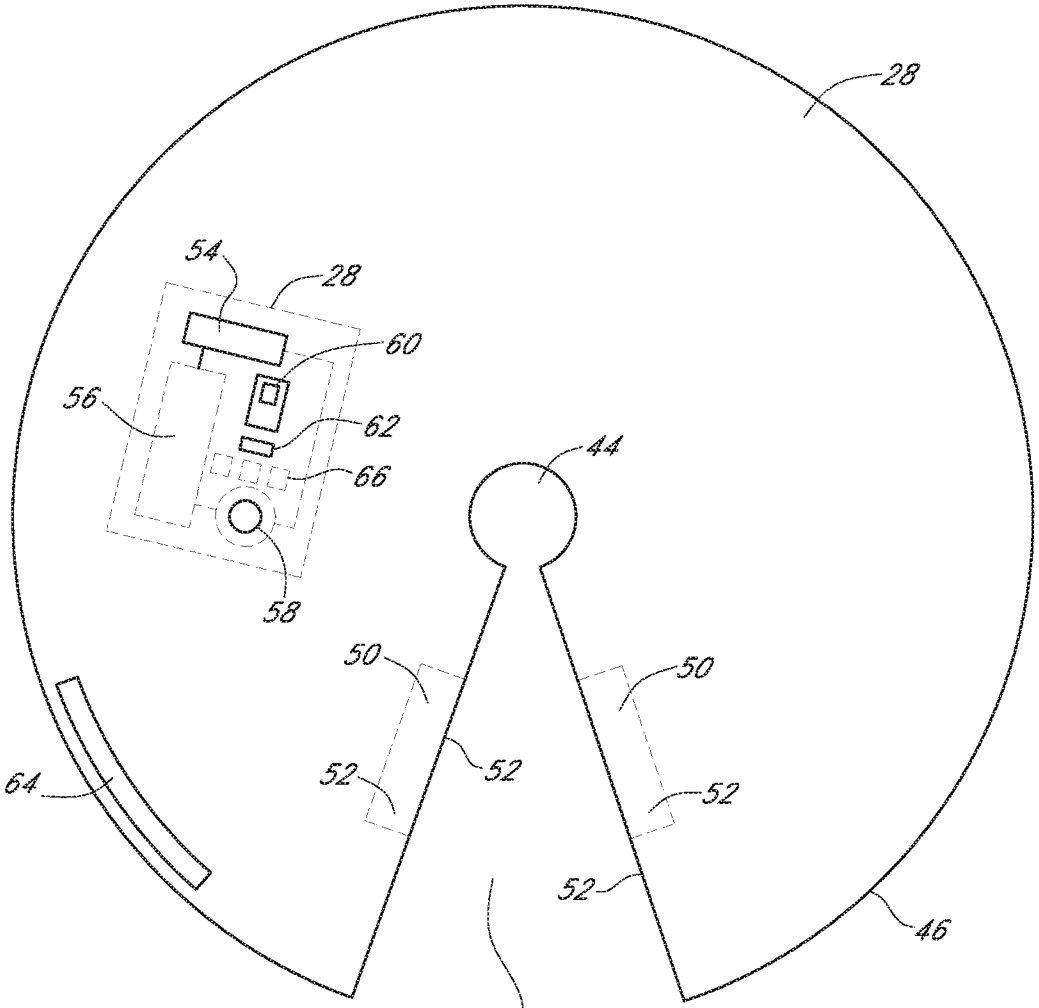
FIG. 3 is a top plan view of a protective cover for a warning system.
Figure 4B:
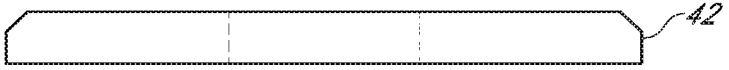
FIG. 4 is a side sectional view of a warning system.
Figure 4A:
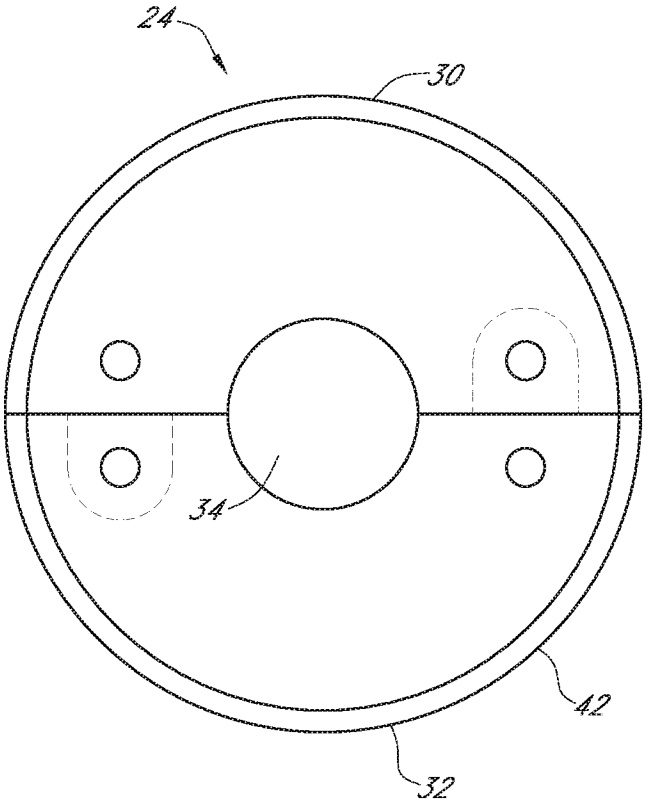
Figure 5:
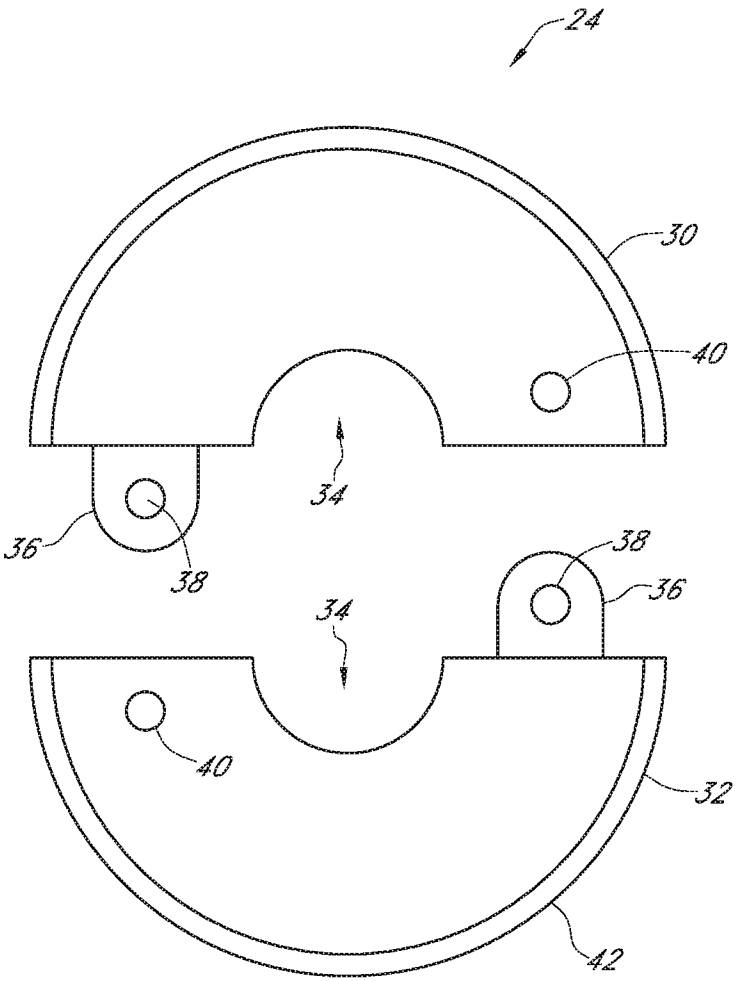
FIG. 5 is a detailed view of an adapter for a warning system.

Referring to the Figures a warning system 10 is used with a fire sprinkler head 12 to protect the fire sprinkler head 12 during construction, remodeling, and demolition projects. Fire sprinkler heads come in many shapes and sizes and generally include a frame or housing 14. The frame 14 has a threadable connecting tube 16 that is threadably received by a water supply pipe 18 or alternatively a hub reducer 20 attached to the water supply pipe 18. The frame also includes thermal linkage, an orifice, a cap that seals the orifice (all conventional and not shown) and a deflector 22.

The warning system 10 includes an adapter 24, a protective cover 26, and a control system 28. The adapter 24 is of any size, shape, and structure that slips over the threadable connecting tube or water supply line 16 to provide a surface that supports the protective cover 26. In one example, the adapter 24 includes two semi-circular pieces 30 and 32, similar to an escutcheon, that has a central opening 34. Each semi-circular piece 30 and 32 has a tab 36 that extends outwardly from an inner edge 37 having a snap projection 38 on one side of the central opening 34, and a snap opening 40 on the other side. The tab 36 and snap projection 38 on one disk 30/32 are positioned to align with the snap opening 40 on the other disk 30/32 so that the snap projection 38 is received within the snap opening 40 to hold the disks together. Preferably, an outer edge 42 of the adapter 26 is chamfered. The adapter 26 is preferably made of metal or a rigid plastic and is made in different sizes to accommodate connecting tubes 16 having different diameters.

The protective cover 26 is of any size, shape, and structure. In one embodiment the cover 26 is frusto-conical with a central opening 44. Extending from the central opening 44 to an outer edge 46 is a radial slit 48. Preferably, the cover 26 is made of a highly visible or photo-luminescent flexible material (or alternatively painted) that preferably has elastic properties to spring back into place after installation. Alternatively, a closure device 50 such as magnets 52, or the like are mounted on the edge 46 of the radial slit 48. Also, preferred, is that the exposed, underside is enclosed within a wire form fixture (not shown).

Embedded within or mounted on/attached to the protective cover 26, is the control system 28. The control system 28 includes at least one power supply 54 such as a battery and circuitry 56 for operating an alarm that is connected to the power supply 54. Preferably, as one example, connected to the circuitry 56 is a two position switch 60. Also connected to the circuitry 56 and positioned on the surface is a power indication light 62 and a perimeter light 64 may or may not be included in design due to energy consumption issues. A plurality of sensors 66, connected to the circuitry 56, are integrated with or detachable from the cover 26. Preferably the plurality of sensors 66 include motion sensors and/or tilt sensors. Finally, connected to the circuitry 56 is an alarm 68 which is audible such as a bell, electronic sounder, horn, siren, tone, or voice and/or visual such as a signal light, flashing light, or strobe (i.e. a perimeter light 64).

To install, the adapter 24, in one example, is positioned about the threaded connection tube 16 and disks 30 and 32 are snapped together so that tube 16 is received within central opening 34. Next, the protective cover 26 is temporarily deformed or moved creating an opening via the radial slit thus allowing installation around threaded connection above the adapter 24. The protective cover 26 does not attach to the pipe, it rests on the adapter, providing the ability to move freely upon contact so that the cover 26 springs back into a cone shape over adapter 24. Alternatively the cover 26 is closed using the closure device 50. The cover 26 is adjusted to a level plane and the switch 60 is slid to an on position.

During operation, preferably the perimeter lights 64 may or may not be on, and the power indication light or other indicator 62 is on. If the protective cover 26 is disturbed by physical force, the sensors 66 will send a signal to the circuitry 56 that will send a signal activating the alarm 68. To turn off the alarm 68, switch 60 or method to reset is slid to an off position. The system is reset by adjusting the protective device back to level plane position then subsequently sliding switch 60 or activating other device to the on position. When a project is completed, the system 10 is removed from the sprinkler head 12 and stored for future use.

From the above discussion and accompanying figures and claims it will be appreciated that the warning system 10 offers many advantages over the prior art. It will be appreciated further by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A warning system for protecting a fire sprinkler head, comprising:

an adapter adapted to slip over a portion of a fire sprinkler head;

a protective cover that engages the adapter;

a control system associated with the protective cover;

wherein the adapter includes a two piece split disk having a first piece and second piece;

the first piece and the second piece each having a central opening;

the first piece of the two piece split disk has a first snap opening aligned with a first tab and a first snap projection that extends outwardly from a first inner edge of the second piece of the two piece split disk;

the second piece of the two piece split disk has a second snap opening aligned with a second tab and a second snap projection that extends outwardly from a second inner edge of the first piece of the two piece split disk; and wherein the first snap opening is configured to receive the first snap projection and the second tab opening is configured to receive the second snap projection such that the first piece and the second piece of the two piece split disk are held together.

2. The system of claim 1 wherein the protective cover has a frusto-conical shape with a central opening and a radial slit that extends from the central opening to an outer edge of the protective cover.

3. The system of claim 1 wherein the protective cover has a central opening, a slit that extends from the central opening to an outer edge of the protective cover, and a closure device mounted to an edge of the slit.

4. The system of claim 3 wherein the closure device is a plurality of magnets mounted to the protective cover.

5. The system of claim 1 wherein the control system includes at least one power supply, a circuitry, a plurality of sensors, and an alarm.

6. The system of claim 5 wherein the control system further includes a two position switch connected to the circuitry and a perimeter light.

7. The system of claim 5 wherein the control system further includes a power indication light.

8. The system of claim 5 wherein the plurality of sensors includes a motion sensor.

9. The system of claim 5 wherein the plurality of sensors includes a tilt sensor.

10. The system of claim 5 wherein the plurality of sensors are configured to sense when the protective cover is disturbed by a physical force.

11. The system of claim 10 wherein when the physical force is sensed, the sensors are configured to send a signal to the circuitry that activates the alarm.

12. The system of claim 1 wherein the fire sprinkler head has a threadable connecting tube connected to a water supply pipe.

13. The system of claim 1 wherein the first piece and the second piece have a semi-circular shape.

14. The system of claim 1 wherein the protective cover is made of a photo-luminescent flexible material having elastic properties.

15. A warning system for protecting a fire sprinkler head, comprising:

an adapter adapted to slip over a portion of a fire sprinkler head;

a protective cover that engages the adapter; and a control system associated with the protective cover; wherein the protective cover has a central opening, a slit that extends from the central opening to an outer edge of the protective cover, and a closure device mounted to an edge of the slit.

* * * * *